United States Patent [19]

Hetland

[11] 4,214,547

[45] Jul. 29, 1980

[54] RIDER PROPELLED BOAT

[76] Inventor: Philip R. Hetland, 915 River Dr., Moorhead, Minn. 56560

[21] Appl. No.: 929,351

[22] Filed: Jul. 31, 1978

[51] Int. Cl.[2] ..... B63H 1/30; B63H 5/00

[52] U.S. Cl. ..... 440/13; 440/22

[58] Field of Search ..... 115/28 R, 28 A, 29, 115/30, 31-33, 25, 19, 20, 21

[56] References Cited

U.S. PATENT DOCUMENTS

| | | | |
|---|---|---|---|
| 2,195,527 | 4/1940 | Whiting | 115/28 R |
| 3,236,203 | 2/1966 | Bramson | 115/19 |
| 3,254,622 | 6/1966 | Bramson | 115/25 |
| 3,256,850 | 6/1966 | Bramson | 115/28 R |
| 3,358,636 | 12/1967 | Curtiss | 115/28 R |
| 3,640,240 | 2/1972 | Stein | 115/28 R |
| 3,722,015 | 3/1973 | Miller | 115/28 R |
| 3,773,011 | 11/1973 | Gronier | 115/28 R |
| 3,845,733 | 11/1974 | Jackman | 115/28 R |

OTHER PUBLICATIONS

Flipper Craft Brochure–for date, note spec., p. 1, lines 27+.

*Primary Examiner*—Trygve M. Blix
*Assistant Examiner*—D. W. Keen
*Attorney, Agent, or Firm*—Kinney, Lange, Braddock, Westman and Fairbairn

[57] ABSTRACT

An amusement device comprising a boat, for a rider, which is formed of lightweight material, and permits the rider to stand on the boat much like on a surf board and by rolling the boat about its longitudinal axis causing provided fins to flex and form propulsion apparatus for the boat.

5 Claims, 6 Drawing Figures

RIDER PROPELLED BOAT

BACKGROUND OF THE INVENTION

1. Field of the Invention

The present invention relates to amusement devices or recreational water vehicles and more particularly to a self-propelled boat that is operated through the manipulation of fins by the shifting of weight of the operator of the boat.

2. Prior Art

In the prior art, various types of recreational boats have been advanced. For example, U.S. Pat. No. 3,845,733 illustrates a boat which has a pair of transversely elongated fins that extend upwardly at an angle with respect to the horizontal plane, and are pivotally mounted for movement of the fins. However, considerable structure is necessary for providing adequate bracing for the fins and also for the pivotal mounting, and the location of the fins would likely cause considerable side to side slewing of the boat.

U.S. Pat. No. 3,773,011 also shows a fin structure that is attached to the lower front end of a floating body. There are a pair of rods that diverge from one another in a rearward direction and have outer end portions that extend rearwardly in parallel relationship to one another. The leading edges and transverse outer longitudinal extending edges of a diaphragm are attached to these rods.

Additionally, the applicant was involved in the making, using and selling, more than one year prior to this application, of a small self-propelled boat which had a pair of fins that extended in vertical planes beneath the boat, much like rudders, and upon slewing the boat from side to side, would cause the boat to be moved forwardly. However, such a craft was rather difficult to operate satisfactorily or to obtain any motion. The boat was sold under the name of "Flipper Craft".

Additional patents which illustrate the general state of the art include the following:

U.S. Pat. No. 3,256,850—C. H. Bramson
U.S. Pat. No. 3,236,203—C. H. Bramson
U.S. Pat. No. 3,254,622—C. H. Bramson
U.S. Pat. No. 3,722,015—W. S. Miller et al.
U.S. Pat. No. 3,358,636—A. J. Curtiss et al.
U.S. Pat. No. 3,204,951—M. Grain
U.S. Pat. No. 2,195,527—J. Whiting
U.S. Pat. No. 3,640,240—E. Stein

SUMMARY OF THE INVENTION

The present invention relates to a "self-propelled" boat which is propelled by an operator upon rocking the boat about its longitudinal axis. The boat is made of a plastic material, molded to be hollow, and can be filled with foam for extra rigidity and safety. The lower or hull side portions of the boat are slightly rounded and the hull is rounded up in a general rounded shape. The front prow portion thus tends to ride out of the water and shed water as it moves along. The operator stands toward the rear half and the rear portion rests more deeply in the water. When the operator shifts his weight from side to side the boat will rock about its longitudinal axis quite easily. The rolling motion can be quite easily done through leg action of the user and upon rocking the boat, flippers positioned adjacent opposite lateral edges below the rounded lower surfaces are flexed up and down and form a propelling action forcing the boat to move forwardly.

The flippers are held so that the forward edges are attached to a frame. The flippers extend almost horizontally when the boat is in its normal floating position. The inner edges of the flippers (the edges near the center of the boat) tilt upwardly slightly. The flippers extend rearwardly from the frame and are not restrained except at their leading edge. The fins are made of a polypropylene approximately ⅛ to 3/16 inch thick, and when fastened along the leading edges they will bend and flex along this edge from normal action of the water as the boat is rocked during use. There is no need for separate hinge pins or supports, other than a simple framework which may include upright support members adjacent the outer edges of the boat.

The craft itself has a sufficient depth of hull to provide adequate flotation, and not to ride too shallow in the water. The bottom surface cannot be exceedingly flat in relation to a horizontal plane or it will not rock properly. Thus, a properly shaped and properly sized hull is important.

DESCRIPTION OF THE PREFERRED EMBODIMENT

Figure 1:
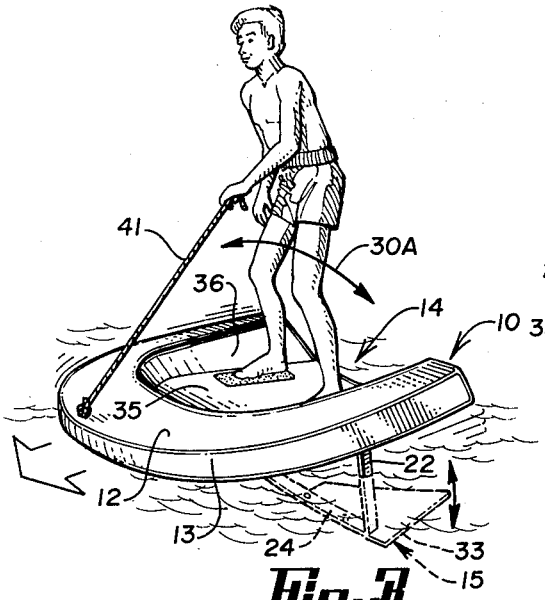
FIG. 1 is a perspective view of an amusement craft or boat made according to the present invention.
Figure 2:
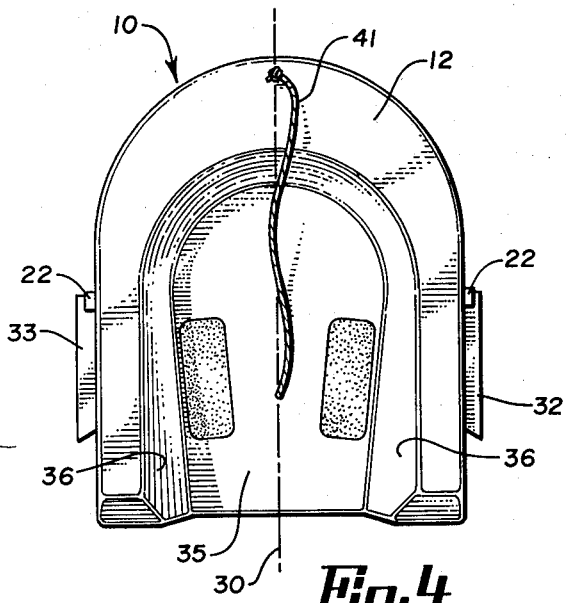
FIG. 2 is a top plan view of the boat of FIG. 1.

The boat structure of the present invention illustrated generally at 10 comprises a hollow molded hull 11 made of suitable material such as rotationally molded high density polyethylene, so that the interior is generally hollow. The boat includes an upper deck 12, a front end portion 13, a operator's platform or standing area 14 adjacent the rear of the boat which is dropped down from the deck. A pair of propulsion fin assemblies indicated generally at 15 are mounted below at the lower surface of the hull on each side of the boat.

The boat hull itself is formed so that the forward portion has a generally rounded front lower surface 12A on the underside. This surface joins the bottom surfaces of the boat adjacent a transverse junction indicated at 20.

A frame 21 is attached to the mid portions of the boat, and includes legs 22 which are fastened as at 23 to the under surfaces of the boat adjacent the outer edges thereof. The legs extend downwardly from the boat edges and a cross support 24 extends across the boat as shown. The legs are both fastened to the sides of the boat, and the cross member is also fastened to the boat in the center portions as indicated at 25. As can be seen, the rearwardly extending bottom surfaces of the boat on opposite sides of the longitudinal axis of the boat, which is indicated generally at 30, taper upwardly from the keel. These surfaces indicated at 31 form an angle with respect to the horizontal or laterally extending frame section 24, so that when the boat is rocked about its longitudinal axis, the lower surfaces will tend to roll in the water without presenting a great deal of resistance to such roll.

The individual fins indicated generally at 32 and 33 comprise sheets of polypropylene that are fastened to the frame cross member 24 on opposite sides of the keel with suitable fasteners such as small screws indicated at 34.

The operator's standing area 14 has a support wall 35 which extends from just forwardly of the mid section of the boat to the rear. The wall 35 slopes downwardly to permit water that washes up onto the boat to drain easily out the rear of the boat. The support wall 35 then is supported in place with suitable side edge walls defining the standing area that is indicated at 36.

Figure 3:
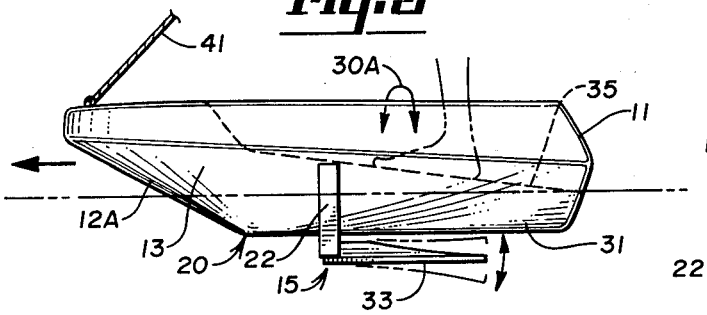
FIG. 3 is a side elevational view of the device of FIG. 1.
Figure 4:
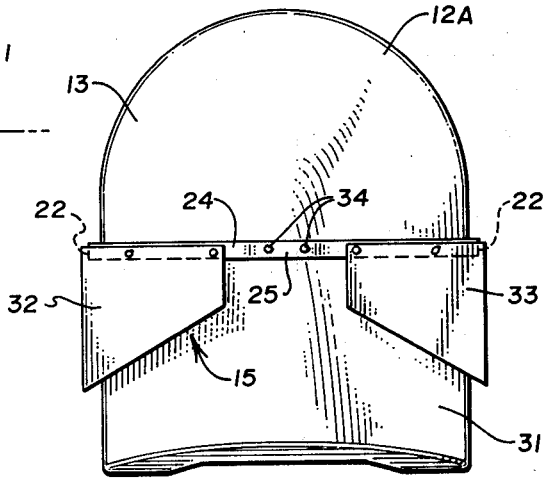
FIG. 4 is a bottom plan view of the boat of FIG. 1.
Figure 5:
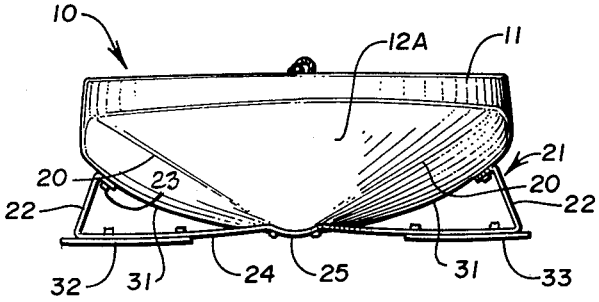
FIG. 5 is a front elevational view of the boat of the present invention.
Figure 6:
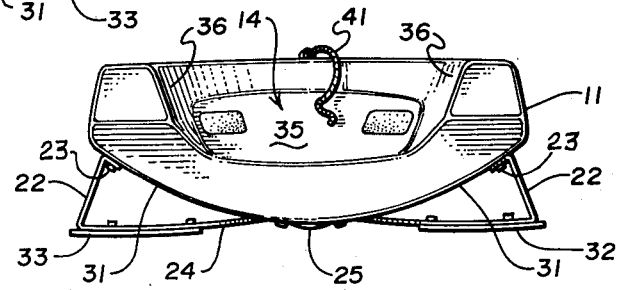
FIG. 6 is a rear elevational view thereof.

It is important to have sufficient vertical depth to the boat adjacent the forward edges so that the support wall 35 can slope downwardly and rearwardly, and further it is important to have the proper contour of the lower surface portions 31. It should be noted that the upper surfaces of the fins and the lower surface portions form apertures through which water can flow as shown in FIG. 5. When an operator is standing in the boat, and the boat is tended to be rocked about its longitudinal axis 30, the general tangent lines for the surfaces would be near the waist of an operator so that the arc of movement of the operator about his waist would cause the boat to roll about its longitudinal axis as shown by double arrow 30A. This rocking will bend the fin 33 up on the side which rolls down as shown in dotted lines in FIG. 3. This downward roll bending one fin up will store energy in the fin along the bend line.

When the boat is rolled in the opposite direction, the other fin will be bent up in the same way, and the fin 33 will act down against the water and resulting in a component of force on the boat tending to urge the boat forwardly. By continued rolling of the boat back and forth about its longitudinal axis, the boat can be propelled, and by shifting the weight and making the rolls uneven, the boat can be turned and steered. A rope member indicated at 41 is grasped by the user for support much like on a surf board, and the user then merely continues to roll and rotate the boat to obtain the desired amount of forward propulsion.

Note in FIG. 5, in particular, that the inner edges of the fins tend to converge upwardly toward the boat slightly so that they are inclined upwardly toward the center of the boat from the horizontal direction to provide a more stable operation during the rocking action. However, the members are primarily horizontal or substantially horizontal.

The polypropylene fins store energy when they are flexed upwardly, and will tend to resiliently return to their normal position and expend this energy when the weight is shifted to the opposite side of the boat, thus causing a continued propulsion force as they resiliently return to horizontal.

The memory properties of polypropylene and planar fins which bend along their mounting axes aid in this action. It should also be noted that the length of the fin where it joins the brace 23 is substantial and it is along this hinge axis that the energy is stored. The fins are cut away in a generally triangular shape having a somewhat longer outer edge than inner edge, to provide more stability and controllability.

The standing area can be provided with frictional surface pads to avoid slipping, so that the action can be sure and positive. If filled with foam, the boat is sink proof, and also is strengthened.

When the boat is submerged in the water, the fins at rest will be generally horizontal with a slight incline upwardly toward the center as described, and the hull itself will be bouyant enough to support the weight of a person with the support wall 35 out of the water, and not under water. This means that the boat has to have sufficient vertical depth for this amount of bouyancy for good operation.

Further, the lightweight metal supports that have the continuous support member going underneath the boat, provide an adequate elongated bending edge for the polypropylene fins to store sufficient energy to aid in the propulsion of the device.

In addition to shifting weight from one leg to another, the flexible fins may be made to flex by different movements such as twisting and jumping. More than one person can ride the watercraft at one time if they stand in tandem. Standing backwards is possible for the skilled, and the boat may be relatively easily propelled while the operator is kneeling.

The boat has a rather short length in the water which facilitates control and turning. The boat will float over large waves and can be used for sunning, games, racing and just plain fun.

What is claimed is:

1. A pleasure craft for an operator comprising a bouyant hull having an upper surface and bottom surface portions which taper from a center keel portion upwardly toward the outer edges adjacent the rear of said hull, a framework supported on said hull and including a single strap fixed to the center keel and extending laterally with respect to the hull and having upwardly extending portions adjacent and fastened to the outer edges of the hull to form generally laterally extending portions under each of the bottom surface portions of the hull and spaced therefrom, a pair of planar flexible fin members nonrotatably attached to each of said laterally extending portions, said fin members having a forward edge supported along said laterally extending portions substantially the entire length thereof from the outer edges of the framework to the center of the hull, said fin members extending rearwardly from said laterally extending portions, said fin members being of substantially homogeneous plastic material throughout and of sufficient flexibility to bend along a hinge axis where they join the respective laterally extending portions when the hull is rocked about its longitudinal axis while in the water and to store energy to aid in the propulsion of the hull as the fins tend to return to their normal position.

2. The combination as specified in claim 1 wherein said hull comprises a generally hollow plastic hull, said upper surface including a support platform surface portion recessed below the upper edges of the front and side of the hull, said support platform surface portion being centered on the longitudinal axis of said hull and providing means for a person to place his feet in opposite sides of the longitudinal axis of said hull, the support platform surface portion sloping downwardly to the rear, said hull having no rear wall extending above the support platform surface portion.

3. The combination as specified in claim 1 wherein said framework laterally extending portions are positioned slightly ahead of the normal location of the operator of the hull on said operator support means.

4. The combination as specified in claim 1 wherein said laterally extending portions slope upwardly from the outer edges of the laterally extending portions toward the keel.

5. The combination of claim 1 wherein each fin has an inner edge adjacent the keel and an outer edge adjacent the respective outer edge of the hull, the fin inner edge being shorter than the fin outer edge, and the rear edge of each fin joining the respective fin inner and outer edges, the rear edge thereby tapering rearwardly and outwardly from the fin inner edge.

* * * * *